US005799602A

United States Patent [19]

Trillo

[11] Patent Number: 5,799,602

[45] Date of Patent: Sep. 1, 1998

[54] DOCKING FORK

[76] Inventor: Joseph Trillo, 643 East Ave., Warwick, R.I. 02886

[21] Appl. No.: 942,098

[22] Filed: Oct. 1, 1997

[51] Int. Cl.[6] ..... B63B 9/00

[52] U.S. Cl. ..... 114/221 R; 294/19.1

[58] Field of Search ..... 114/221 R, 230; 294/19.1; 119/801, 802, 803, 804

[56] References Cited

U.S. PATENT DOCUMENTS

| | | | |
|---|---|---|---|
| 3,677,597 | 7/1972 | Stipek | 114/221 R |
| 3,841,685 | 10/1974 | Kolodziej | 114/221 R |
| 4,635,986 | 1/1987 | Johns | 294/19.1 |
| 5,009,181 | 4/1991 | Upchurch | 114/221 R |
| 5,116,260 | 5/1992 | Upchurch | 294/19 R |
| 5,699,748 | 12/1997 | Linskey, Jr. et al. | 114/221 R |

FOREIGN PATENT DOCUMENTS

| | | |
|---|---|---|
| 2225997 | 6/1990 | United Kingdom . |
| 2272875 | 1/1994 | United Kingdom . |

*Primary Examiner*—Stephen Avila
*Attorney, Agent, or Firm*—Barlow & Josephs, Ltd.

[57] ABSTRACT

A docking fork for facilitating the placing of a docking line loop about an object, such as a piling or cleat, to assist in the docking of a marine vessel, is provided. The docking fork includes a substantially U-shaped tray member defining upstanding walls and a floor for receiving and maintaining a docking line loop in an open condition in preparation for positioning about the object. The docking fork, supporting the docking line loop, is placed over a piling and is pulled away thus leaving the docking line loop alone about the object in preparation for tightening and subsequent docking of the vessel.

8 Claims, 4 Drawing Sheets

DOCKING FORK

BACKGROUND OF THE INVENTION

The present invention relates generally to a device for supporting a line loop. More specifically, the present invention relates to a device for supporting a docking line loop to facilitate the docking of a marine vessel.

In the marine field, it has been well known to employ a docking line loop to assist in the docking of a marine vessel. Such docking of a marine vessel can sometimes be a difficult endeavor, specifically when attempting to throw or tie a rope or line from a marine vessel around a cleat, a free-standing independent piling or a piling connected to a dock in order to secure the marine vessel from a distance. The difficulty becomes more acute when there is no person to whom the lines can be thrown or handed.

The traditional method of securing a docking line to an anchorage is to attempt to lasso the line around the piling or cleat by making the end of the line into a loop or noose and throwing it over the top of the anchorage or handing the line to an available dock assistant on shore. This traditional practice is inadequate because it entails a great deal of skill agility and accuracy when throwing a docking line to the piling or cleat, particularly if there is considerable distance between the marine vessel and the anchorage. This method also can be unsafe if the boater tries to lean over the edge of the boat in an attempt to reduce the distance when lassoing the anchorage. Additionally, there is also a greater risk that the line could be improperly fastened or could come undone once fastened.

Many attempts have been made in the prior art to address the foregoing problems and concerns. Docking systems, of the general type to which the present invention relates, are disclosed, for example, in U.S. Patents as Brown, U.S. Pat. No. 3,473,505, issued Oct. 21 1969; Reynolds, U.S. Pat. No. 3,670,686, issued Jun. 20, 1972; Onstwedder, Jr., U.S. Pat. No. 4,864,956, issued Sep. 12, 1989; Pina, U.S. Pat. No. 3,861,346, issued Jan. 21, 1975; and Bailhe, U.S. Pat. No. 2,561,487, issued Jul. 24, 1951.

U.S. Pat. No. 3,473,505, issued to Brown, discloses a system of weighted chock cleats and a holding base, does not allow the boater to utilize existing docking apparatus provided in order to secure the line from the boat. Instead, it requires the user to install a chock cleat and special line holder that must be either installed previously on the dock, or available to the boater as a free-standing buoy. Additionally, the boater must still posses agility and precise aim when trying to throw the chock cleat to the receptacle.

Further, U.S. Pat. No. 3,670,686, issued to Reynolds, relates to the procedure for marine docking. Reynolds '686 proposes a submerged mooring system for a tanker and is, therefore, inappropriate for facilitating marine docking.

The two inventions by Onstwedder (Yieldable Mooring Line for a Boat) and Bailhe (Cable Mooring Pennant) relate to alternatives to an actual docking line, each respectively proposing, a springed line and a cable line for mooring. Neither of these disclosures provide a docking fork for supporting a docking line loop for docking a marine vessel.

The boat docking tool disclosed in U.S. Pat. No. 3,861,346, issued to Pina, is similar in many respects; however, there are several key distinguishing features. The tool disclosed in Pina '346 does not allow the user to place the docking line directly on the piling or cleat but instead uses a one piece metal adjustable loop and pole to hold the vessel. The Pina '346 tool is not designed to be used in conjunction with an existing boat pole or conventional braided and nylon lines. Additionally, due to the limited length of the Boat Docking Tool, the user is unable to reach extended distances using this method. Harder to store on board and less lightweight, Pina's Boat Docking Tool does not offer an economical and practical boat docking device.

In addition to the foregoing prior art references, there have been other attempts to provide an apparatus for manipulating a loop for lassoing an object. For example, U.K. Patent Application No. 2,225,997A discloses an apparatus for manipulating a lasso for lassoing and object. This application discloses the use of calipers, which optionally include VELCRO, for securing the loop line about the apparatus frame. This device suffers from the drawbacks of requiring the line to be engaged by each of the calipers or to have VELCRO material sewn directly on the line for adhesion to complementary VELCRO on the frame. Moreover, the effectiveness of VELCRO is greatly reduced if the loop line is wet.

Further, U.S. Pat. No. 3,677,597, issued to Stipek, discloses a loop-supporting device for positioning a line loop about an object. The apparatus of Stipek requires the loop to be manually clipped to the inner periphery of the frame as well as the frame to be clipped into a closed position. Upon positioning of the loop, the frame springs open requiring the frame to be reset.

The foregoing patents fail to adequately solve the problems associated with docking a marine vessel. The prior art requires clipping of the loop line to the frame and, therefore, cannot easily accommodate lines of varying sizes. Due to the demand for an apparatus for assisting in the docking of a marine vessel which is flexible in its use, it is desirable for such an apparatus to be capable of accommodating docking lines of varying sizes and material types. It is also desirable for such an apparatus to be easily and quickly prepared for operation without sacrificing effectiveness.

SUMMARY OF THE INVENTION

The present invention preserves the advantages of prior art devices for supporting line loops and assisting in the docking of marine vessels. In addition, it provides new advantages not found in currently available devices, and overcomes many disadvantages found in such currently available devices.

In accordance with the present invention, the problems of the prior art docking devices are overcome by means of a relatively inexpensive and easy to store docking fork which attaches to an extended boat pole and allows the user to easily and effectively transfer and tie the line directly to the piling, cleat or other object at a greater distance. It also eliminates the need for dock assistance when trying to tie a line to the cleat or piling.

The present invention consists of a device in the form of a U, such as a fork, that attaches onto the end of an existing boat pole, transfers and ties a docking line directly to a cleat or piling. The U-shaped device includes a floor and inner and outer walls emanating upwardly therefrom to form a substantially U-shaped tray member. The U-shaped tray member supports and contains a docking line loop therein thereby maintaining the docking line loop in an open loop configuration in preparation for encirclement around an object such as a cleat or docking piling. Floor area in the bight portion of the U-shaped tray member is enlarged with greater distance between the inner and outer walls to accommodate the knot or eyelet loop region of the line loop.

In operation, the docking fork is preferably attached to an existing boat pole, which may or may not be extendible, by inserting the distal end of the boat pole into the base of the tray member. A docking line loop is then placed in the U-shaped tray with knot portion residing in the bight portion of the tray while opposing sides of the loop are housed within the upstanding walls. The end of the loop opposite the knot spans from the respective opposing free ends of the U-shaped tray. The user extends the boat pole with the docking fork attachment and affixed loosely knotted line over the cleat or piling so that the exposed portion of the line is brought behind the cleat or piling. The boat pole with the attached fork is then pulled toward the user thereby lifting the line loop from the U-shaped tray and leaving behind a tied line to anchor the vessel.

It is therefore an object of the present invention to provide a safer, easier and more effective method of transferring and securing a docking line from a marine vessel to a piling or cleat at a distance.

It is also an object of the present invention to provide such a device in a lightweight, practical and inexpensive form which can be easily stored on a marine vessel and used in conjunction with existing common boat poles.

Another object of the present invention is to provide a docking fork which operates effectively in all weather conditions.

It is a further object of the present invention to provide a docking fork which can be quickly and easily prepared for use without the need for clips, adhesive or hook and loop fastening material.

It is yet a further object of the present invention to provide a docking fork which can accommodate lines of varying sizes and materials.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
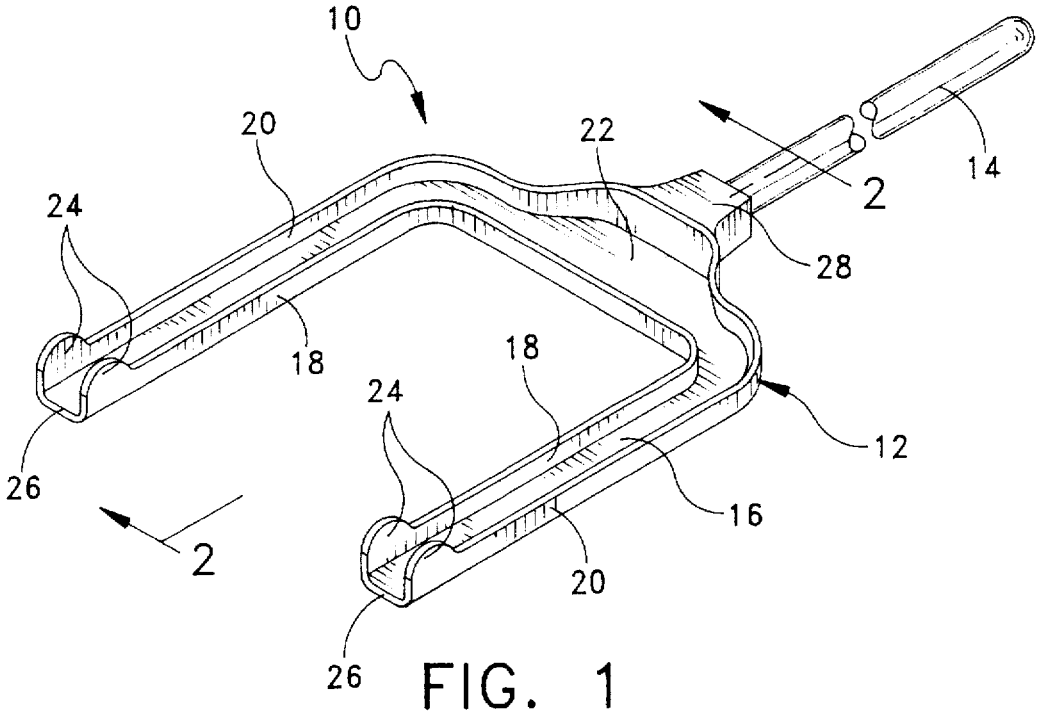
FIG. 1 is a perspective view of the docking fork in accordance with the preferred embodiment of the present invention.
Figure 2:
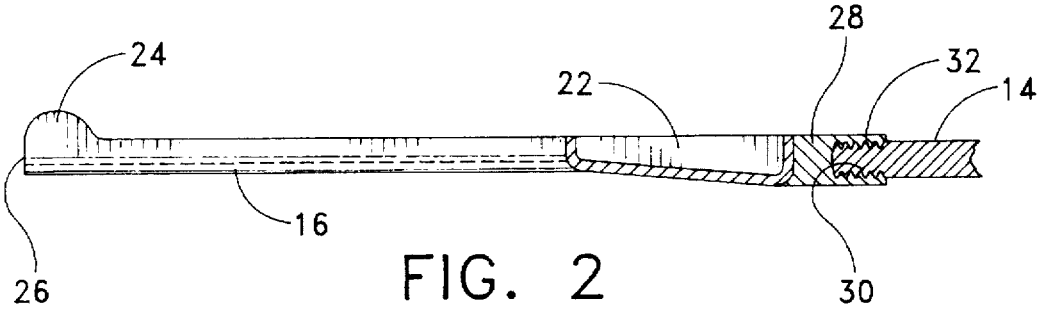
FIG. 2 is a cross-sectional view through the line 2—2 of FIG. 1.

Referring to FIG. 1, a perspective view of the docking fork 10 of the present invention is shown. A substantially U-shaped tray member 12 is provided with a floor 16 as well as inner upstanding wall 18 and outer upstanding wall 20 emanating upwardly therefrom forming a channel-like configuration. The substantially U-shaped tray member 12 includes a neck region 28 for threadably receiving boat pole 14 which is optionally extendible. As shown in FIG. 2, boat pole 14 includes male threads 32 on a free end for threadable engagement with female threads 30 within neck portion of substantially U-shaped tray member 12.

Figure 3:
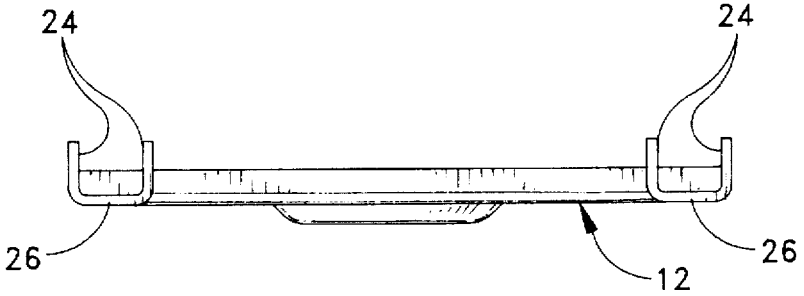
FIG. 3 is a front elevational view of the docking fork of FIG. 1.

Referring now to FIGS. 1-3, inner upstanding wall 18 and outer upstanding wall 20 each include guide members 24 at their respective free ends which correspond to the free and open ends 26 of substantially U-shaped tray member 12. As will be discussed in detail below, guide members 24 provide additional control over a docking line received by tray member 12. In addition, bight portion 22 of tray member 12 provides additional control over a docking line to be received within tray member 12.

Figure 4:
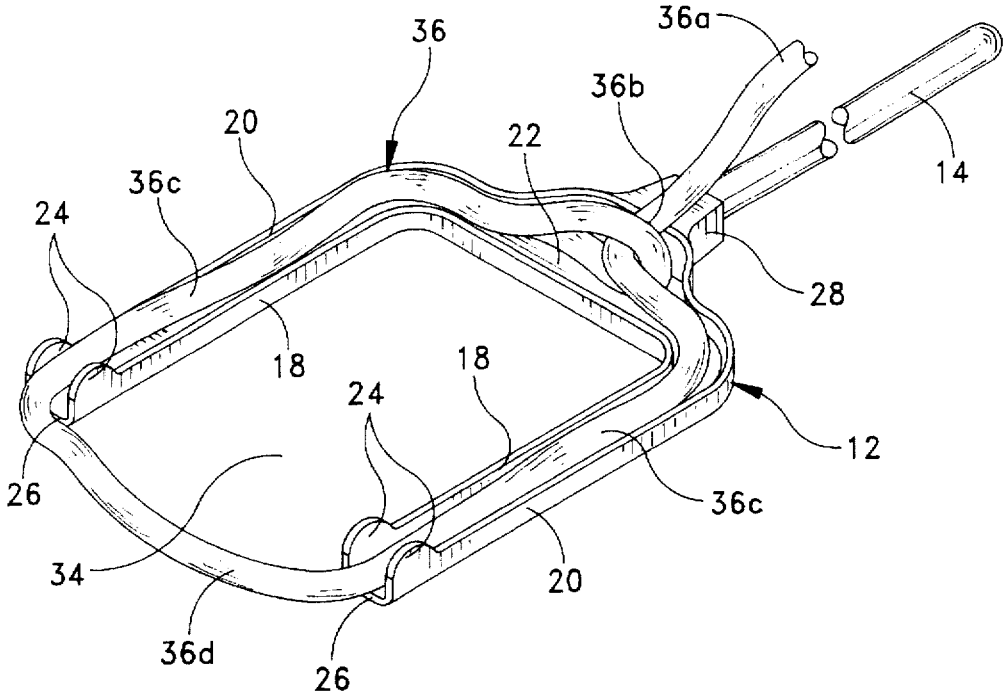
FIG. 4 is a perspective view of the docking fork of FIG. 1 maintaining a docking line loop in an open loop condition.
Figure 5:
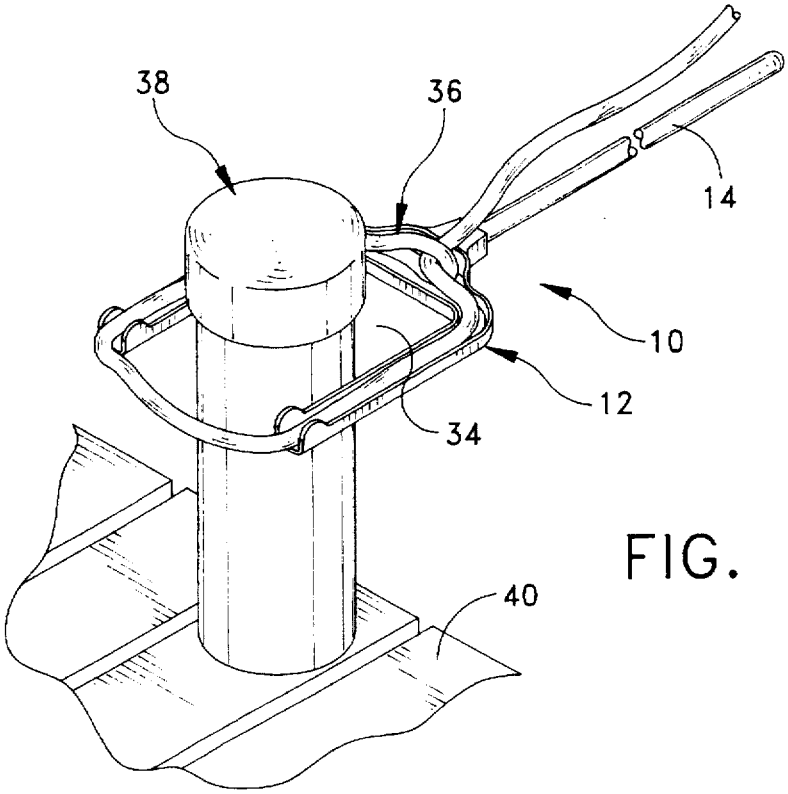
FIG. 5 is a perspective view of the docking fork of FIG. 1 showing the placing of a docking line loop about an object.
Figure 6:
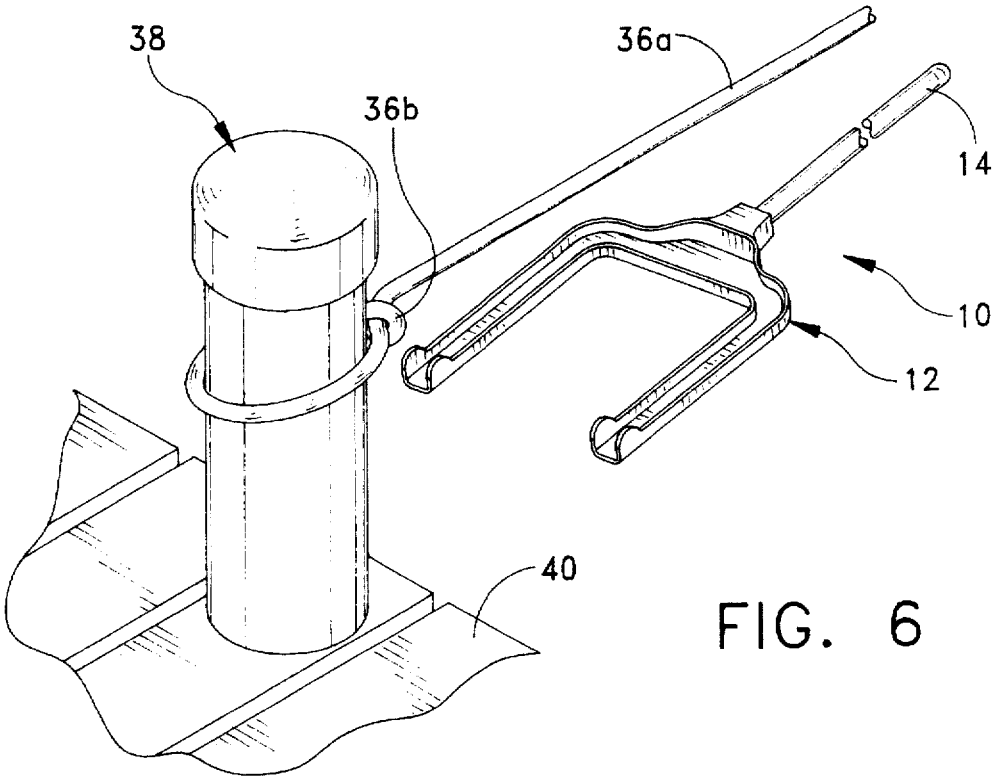
FIG. 6 is a perspective view of the docking fork of FIG. 1 showing the removal of the docking fork of FIG. 1 to leave remaining the docking line loop about an object.
Figure 7:
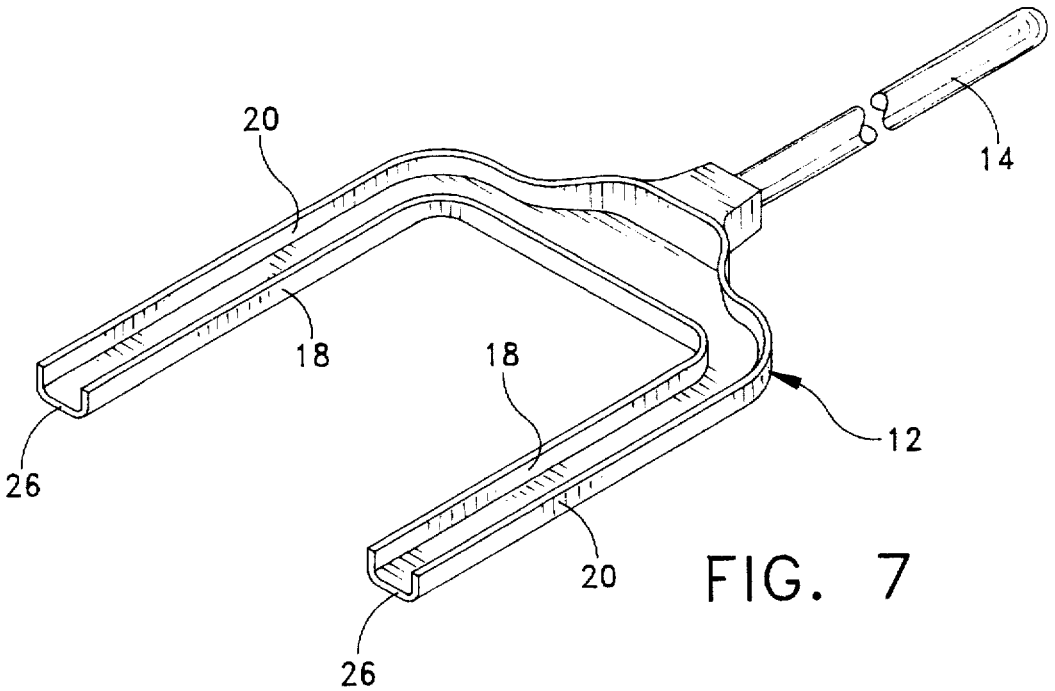
FIG. 7 is a perspective view of an alternative embodiment of the docking fork in accordance with the present invention.
Figure 8:
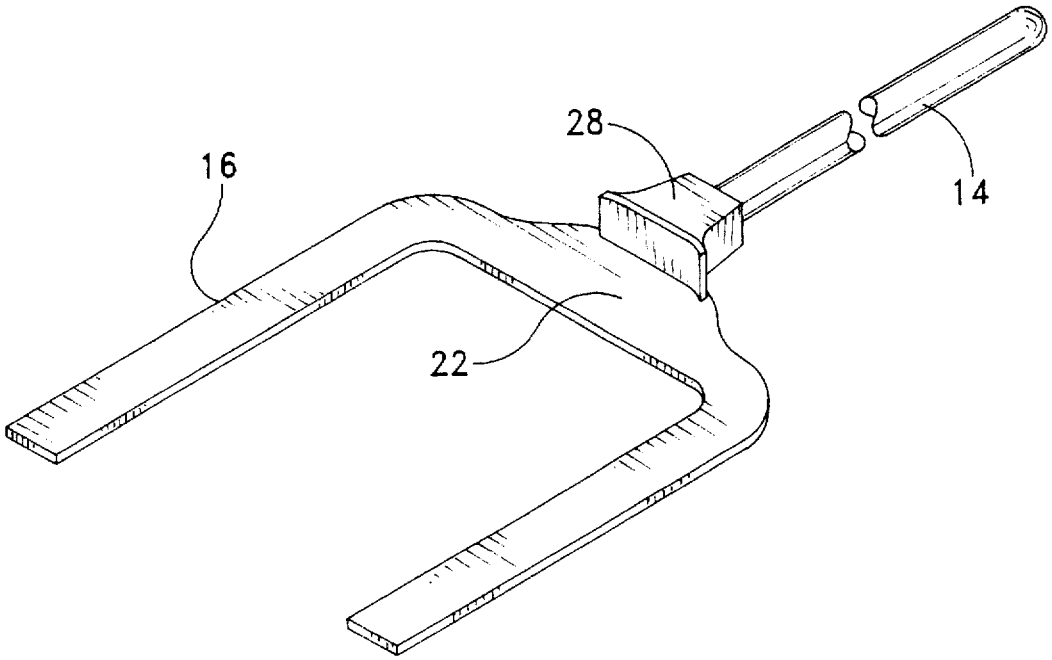
FIG. 8 is a perspective view of another alternative embodiment of the docking fork in accordance with the present invention.

Turning now to FIGS. 4–6, operation of the docking fork, in accordance with the present invention, is shown. Referring now to FIG. 4, a perspective view of the docking fork device 10 of the present invention is shown retaining a line loop, generally shown as 36, in an open loop configuration. More specifically, line loop 36 includes a line lead portion 36*a*, a loose knot portion 36*b*, opposing loop sides 36*c* as well as closed loop end portion 36*d*. Loose knot portion 36*b* of line loop 36 rests on floor 16 within bight portion 22 of tray member 12. The distance between inner upstanding wall 18 and outer upstanding wall 20 is greater in bight portion 22 to fully accommodate loose knot portion 36*b*. Further, opposing loop sides 36*c* rests within a channel formed between inner upstanding wall 18 and outer upstanding wall 20 to exit past free ends of U-shaped tray 12 where closed loop end portion 36*d* spans thereacross. Guides 24 emanate upwardly from inner upstanding wall 18 and outer upstanding wall 20 to provide additional containment for line loop 36 particularly at free ends 26 where it is susceptible for the line loop 36 to be ejected from tray member 12. Optionally, guide members 24 may be positioned about the periphery of tray member 12 for added security. It should also be understood that such guides 24 are optional and need not be employed while still being within the scope of the present invention. FIG. 7 illustrates such as docking fork device without the guides 24. In addition, inner upstanding wall 18 and outer upstanding wall 20 may be completely omitted in accordance with the alternative embodiment of the present invention shown in FIG. 8.

Referring next to FIG. 5, now that line loop 36 has been placed in tray member 12 and currently maintained in an open loop configuration, it is in preparation for positioning over an object 38, such as a piling or cleat, which is connected to a support 40, such as a dock, or the like. Docking fork device 10, with line loop 36 resting thereon, is placed over object 38 so object 38 passes through aperture 34 formed by line loop 36. As shown in FIG. 6, docking fork device 10 is pulled away toward the user thereby ejecting line loop 36 from tray member 12 to leave line loop 36 remaining about object 38. As a result, line loop 36 is effectively tied about object 38 without the need for the user to accurately throw line loop 36 in a lasso-type fashion which can be dangerous and often frustrating. In contrast, the present invention permits precise placement of line loop 36 over the desired object.

The docking fork device 10 of the present invention may also be operated without boat pole 14 connected to the U-shaped tray member 12. For example, in smaller boats, an extension may not be necessary but the loop maintaining ability of the tray member of the present invention may still be employed to facilitate placing the docking line loop about an object. In addition, there are many applications of the docking fork device of the present invention which are outside the marine industry. For example, the present invention may be employed to lasso livestock, trees, and other objects.

The U-shaped tray member is preferably made of plastic but may be manufactured out of other materials in accordance with the desired application. Further, the female threads 30 within the neck portion 28 of tray member 12 are preferably standard in size so as to except standard boat poles employed in the industry.

It would be appreciated by those skilled in the art that various changes and modifications can be made to the illustrated embodiments without departing from the spirit of the present invention. All such modifications and changes are intended to be covered by the appended claims.

What is claimed is:

1. A docking fork for assisting in the securing of a docking line to a structure to be captured, comprising:

a substantially U-shaped fork member having an inner perimeter edge, an outer perimeter edge and an upper surface disposed therebetween; said substantially U-shaped fork member including two substantially parallel arm portions, each having free ends, and a bight portion;

an inner upstanding wall connected to and emanating upwardly from said inner perimeter edge; an outer upstanding wall connected to and emanating upwardly from said out perimeter edge; said inner upstanding wall, said outer upstanding wall and said upper surface of said U-shaped fork member defining a substantially U-shaped tray member with a floor with a distance being between said inner upstanding wall and said outer upstanding wall;

said U-shaped tray member being positioned to a receive and support a line loop, having a knot region, opposing sides and closed end, on its floor; said line loop residing in said U-shaped tray member with said opposing sides of said line loop residing on said parallel arm portions and said knot region residing over said bight portion of said U-shaped fork member; said opposing sides of said line loop and said knot region being bounded by said inner upstanding wall and said outer upstanding wall; said closed end of said line loop spanning from respective free ends of said two substantially parallel arm portions to maintain said loop line in an open position; and whereby said loop line is placeable about said structure to be captured for securement upon introduction of a said structure to be captured inside said loop line and pulling away of said U-shaped tray member from fixed structure to thereby release said loop line from said U-shaped tray member.

2. The docking fork of claim 1, further comprising:

an extension pole member detachably affixed to said U-shaped fork member at a location proximal to said bight portion of said U-shaped fork member and extending outwardly away from said bight portion in a direction opposite from which said two substantially parallel arm portions extend.

3. The docking fork member of claim 2, wherein said extension pole is adjustable in length.

4. The docking fork member claim 1, wherein said distance between said inner upstanding wall and said outer upstanding wall is greater in the bight region of said U-shaped fork member than at said two substantially parallel arm portions to accommodate said knot region of said line loop.

5. The docking fork of claim 1, wherein said U-shaped tray member is manufactured of plastic.

6. The docking fork of claim 1, further comprising:

at least one line loop guide affixed to and extending upwardly from said inner upstanding wall; and at least one line loop guide affixed to and extending upwardly from said outer upstanding wall.

7. The docking fork of claim 6, wherein one of said at least one line loop guide is positioned proximal to said free ends of each of said two substantially parallel arm portions of said U-shaped fork member.

8. A docking fork for assisting in the securing of a docking line to a fixed structure, comprising:

a substantially U-shaped fork member having an inner perimeter edge, an outer perimeter edge and an upper surface disposed therebetween; said substantially U-shaped fork member including two substantially parallel arm portions, each having free ends, and a bight portion;

an inner upstanding wall connected to and emanating upwardly from said inner perimeter edge; an outer upstanding wall connected to and emanating upwardly from said out perimeter edge; said inner upstanding wall, said outer upstanding wall and said upper surface of said U-shaped fork member defining a substantially U-shaped tray member with a floor with a distance being between said inner upstanding wall and said outer upstanding wall;

said U-shaped tray member being positioned to a receive and support a line loop, having a knot region, opposing sides and closed end, on its floor; said line loop residing in said U-shaped tray member with said opposing sides of said line loop residing on said parallel arm portions and said knot region residing over said bight portion of said U-shaped fork member; said opposing sides of said line loop and said knot region being bounded by said inner upstanding wall and said outer upstanding wall; said closed end of said line loop spanning from respective free ends of said two substantially parallel arm portions to maintain said loop line in an open position; said distance between said inner upstanding wall and said outer upstanding wall is greater in the bight region of said U-shaped fork member than at said two substantially parallel arm portions to accommodate said knot region of said line loop;

an extension pole member detachably affixed to said U-shaped fork member at a location proximal to said bight portion of said U-shaped fork member and extending outwardly away from said bight portion in a direction opposite from which said two substantially parallel arm portions extend; and whereby said loop line is placeable about a said fixed structure for securement upon introduction of said fixed structure inside said loop line and pulling away of said U-shaped tray member from fixed structure to thereby release said loop line from said U-shaped tray member.

* * * * *